US006158991A

United States Patent [19]

Ohtake et al.

[11] Patent Number: 6,158,991

[45] Date of Patent: Dec. 12, 2000

[54] SCROLL-TYPE FLUID MACHINE IN WHICH A MOVABLE SCROLL MEMBER IS ELASTICALLY URGED TOWARDS A FIXED SCROLL MEMBER

[75] Inventors: Shinichi Ohtake, Ashikaga; Jiro Iizuka, Takasaki, both of Japan

[73] Assignee: Sanden Corporation, Gunma, Japan

[21] Appl. No.: 09/257,376

[22] Filed: Feb. 25, 1999

[30] Foreign Application Priority Data

Feb. 26, 1998 [JP] Japan ..... 10-044821

[51] Int. Cl.[7] ..... F03C 2/00

[52] U.S. Cl. ..... 418/55.3; 418/55.5; 418/57; 464/103

[58] Field of Search ..... 418/55.3, 55.5, 418/57; 464/103

[56] References Cited

U.S. PATENT DOCUMENTS

| | | |
|---|---|---|
| 3,647,268 | 3/1972 | Haines . |
| 4,160,629 | 7/1979 | Hidden et al. . |
| 4,259,042 | 3/1981 | Hidden et al. . |
| 4,406,600 | 9/1983 | Terauchi et al. . |
| 4,457,676 | 7/1984 | Hiraga . |
| 4,468,181 | 8/1984 | Sakamoto . |
| 4,472,120 | 9/1984 | McCullough . |
| 4,474,543 | 10/1984 | Hiraga et al. . |
| 4,492,543 | 1/1985 | Iimori et al. . |
| 4,527,963 | 7/1985 | Terauchi . |
| 4,545,746 | 10/1985 | Sugimoto et al. . |
| 4,589,828 | 5/1986 | Sato et al. . |
| 4,645,435 | 2/1987 | Sugimoto . |
| 4,934,909 | 6/1990 | Suzuki et al. . |
| 5,102,315 | 4/1992 | Terauchi et al. . |
| 5,221,198 | 6/1993 | Izumi et al. . |
| 5,423,663 | 6/1995 | Fukui . |
| 5,435,706 | 7/1995 | Matsumoto et al. . |
| 5,738,504 | 4/1998 | Kitano . |
| 5,911,566 | 6/1999 | Terauchi et al. . |
| 5,915,933 | 6/1999 | Iizuka et al. . |

FOREIGN PATENT DOCUMENTS

| | | | |
|---|---|---|---|
| 123407 | 10/1984 | European Pat. Off. . | |
| 2455196 | 4/1980 | France . | |
| 1960216 | 12/1969 | Germany . | |
| 57-148093 | 9/1982 | Japan | 418/55.3 |
| 59-183090 | 10/1984 | Japan . | |
| 6361790 | 3/1988 | Japan . | |
| 63-154878 | 6/1988 | Japan . | |
| 179185 | 7/1988 | Japan | 418/55.3 |
| 63-179185 | 7/1988 | Japan . | |
| 63-266214 | 11/1988 | Japan . | |
| 1219377 | 1/1989 | Japan . | |
| 6477779 | 3/1989 | Japan . | |
| 1182587 | 7/1989 | Japan . | |
| 1271679 | 10/1989 | Japan . | |
| 2308990 | 12/1990 | Japan . | |
| 105088 | 5/1991 | Japan | 418/55.3 |
| 404094483 | 3/1992 | Japan | 418/55.3 |
| 533811 | 2/1993 | Japan . | |
| 5126140 | 5/1993 | Japan . | |
| 587131 | 6/1993 | Japan . | |
| 7019249 | 1/1995 | Japan . | |
| 9310685 | 2/1997 | Japan . | |
| 881409 | 2/1980 | U.S.S.R. . | |

OTHER PUBLICATIONS

S. Otake et al., "New design approach for a scroll compressor anti–rotation mechanism," (1998).

J. Iizuka et al., "Improvement of scroll compressor for vehicle air conditioning systems," (Society of Automotive Engineers, Inc., 1997).

*Primary Examiner*—Thomas Denion
*Assistant Examiner*—Theresa Trieu
*Attorney, Agent, or Firm*—Baker Botts L.L.P.

[57] ABSTRACT

In a scroll-type fluid machine in which a movable scroll member (3) is placed between a front housing (1) and a fixed scroll member (4), the movable scroll member is elastically urged towards the fixed scroll member by an urging member. The movable and the fixed scroll members are engaged with each other to form a compression space (6) therebetween. It is preferable that the urging member is composed by at least one of races (24, 25) of a ball coupling (5) which is placed between the stationary and the movable scroll members and is for preventing the movable scroll member from being rotated relative to the fixed scroll member.

17 Claims, 5 Drawing Sheets

SCROLL-TYPE FLUID MACHINE IN WHICH A MOVABLE SCROLL MEMBER IS ELASTICALLY URGED TOWARDS A FIXED SCROLL MEMBER

BACKGROUND OF THE INVENTION

The present invention relates to a scroll-type fluid machine having a fixed scroll member and a movable scroll member.

Various scroll-type fluid machines are generally known and widely used in an air conditioning system of an automobile and others. Referring to FIG. 1, description will presently be made as regards a scroll-type fluid machine in an earlier technology.

The scroll-type fluid machine is for use in the air conditioning system of the automobile and has a font housing 1 and a rear housing 2 which is coupled with the front housing 1. The rear housing 2 includes therein a movable scroll member 3 and a fixed scroll member 4. The movable scroll member 3 has an end plate 3*a* and an involute member 3*b* which is integrally formed on one surface of the end plate 3*a*. Similarly, the fixed scroll member 4 has an end plate 4*a* and an involute member 4*b* integrally formed on one surface of the end plate 4*a*. The fixed scroll member 4 is fixed at its end plate 4*a* to the rear housing 2. On the other hand, the movable scroll member 3 is received at the end plate 3*a* by the front housing 1 through a ball coupling 5, and the involute member 3*b* of the movable scroll member 3 is engaged with the involute scroll member 4*b* of the fixed scroll member 4, with a compression space 6 for a refrigerant gas formed between the two involute members 3*b* and 4*b*. The ball coupling 5 has a mechanism which prevents a rotation of the movable scroll member but permits an orbital motion of the movable scroll member along its orbital way. A detailed description of the mechanism and operation of the ball coupling will be made presently in the instant application.

A main shaft 7 is provided in the front housing 1 such that its one end is exposed outside the front housing 1. The main shaft 7 is rotatably supported in the front housing 1 by means of radial bearings 8, 9. On the outer circumferential surface of the front housing 1 is mounted a rotor 12 which is rotatably supported by a radial bearing 11. The rotor 12 is connected with an automobile engine through a belt means (not shown). An armature 13 is provided to an end surface of the rotor 12 with a spaced confronting relation with a very small space relative to the end surface of the rotor 12, and the armature 13 is axially movably supported by an end of the main shaft 7 so that the armature 13 can be displaced resiliently in the axial direction. Further, an electromagnetic solenoid 14 is supported in the front housing 1. The rotor 12, the armature 13 and the electromagnetic solenoid 14 form in combination an electromagnetic clutch device. In other words, when an electric current is applied to the electromagnetic solenoid 14, the armature 13 is attracted and adhered to the end surface of the rotor 12 into a combined form and a driving force of the automobile engine is transmitted to the main shaft 7 through the rotor 12 and the armature 13 so that the main shaft 7 is rotated when the engine is driven.

An eccentric pin 15 is disposed to the other end of the main shaft 7. On the opposite surface of the end plate 3*a* of the movable scroll member 3, an eccentric bush 16 is rotatably supported by a radial bearing 17, and the eccentric pin 15 is inserted into an eccentric hole 16*a* of the eccentric bush 16.

When the main shaft 7 is rotated, the eccentric pin 15 is rotated around an axis of the main shaft 7 and the movable scroll member 3 is driven in an orbital motion through the eccentric bush 16. This forces the compression space 6 to move toward a central portion along the involute members 3*b*, 4*b*, as the compression space 6 reduces its volume to thereby proceed a compression operation of the refrigerant gas. The compressed refrigerant gas passes through a discharge hole 18 which is provided, in correspondence with the central portion of the machine, on the end plate 4*a* of the fixed scroll member 4 to open a discharge valve 19 and is then discharged into a discharge chamber 21 which is formed between the end plate 4*a* and the rear housing 2. In FIG. 1 of the drawing, reference numeral 22 represents a valve holder which serves to press and hold the discharge valve 19.

The refrigerant gas of the discharge chamber 21 is then discharged outside the machine through a discharge port (not shown). On the other hand, the refrigerant gas which is sucked into the suction chamber 23 from a suction port (not shown) of the rear housing 2 is received in and held by the compression space 6 at the outer circumferential portion of the involute members 3*b* and 4*b*.

The ball coupling 5 includes a fixed side race 24 fixedly supported by the front housing 1, a movable side race 25 fixedly supported by the end place 3*a* of the movable scroll member 3, and a plurality of balls 26 disposed between the fixed side race 24 and the movable side race 25. Each of the fixed side and movable side races 24 and 25 is made of a ring-like plate having a plurality of annular grooves for rotation of the balls 26 such that each ball 26 corresponds with each annular groove.

In order to control an axial clearance between the fixed scroll member 4 and the movable scroll member 3, the front housing 1 is in an axially confronting relation with the rear housing 2 with one or more spacers or shims 27 and fixedly coupled with each other by bolts 28. A axial dimension of the shim 27 is suitably selected in accordance with an axial clearance between the fixed scroll member 4 and the movable scroll member 3.

However, it is difficult to select the axial dimension of the shim 27 in an assembly of the scroll-type fluid machine described above, because various kinds of shims must be prepared and a suitable one or more of them must be initially selected and then adapted repeatedly by trial and error to find the most suitable one(s)to finally decide the number and thickness of the shims. Further, there is a problem of supervising a number of, and various kinds of, shims.

SUMMARY OF THE INVENTION

It is therefore an object of the present invention to provide a new scroll-type fluid machine which permits an easy controlling of an axial clearance between the fixed scroll member and the movable scroll member.

Other objects of the present invention will become clear as the description proceeds.

According to the present invention, there is provided a scroll-type fluid machine which comprises a stationary member, a fixed scroll member fixed relative to said stationary member, a movable scroll member placed between said stationary member and said fixed scroll member and engaged with said fixed scroll member to form a compression space between said fixed and said movable scroll members, and urging means placed between said stationary member and said movable scroll member for elastically urging said movable scroll member towards said fixed scroll member.

DESCRIPTION OF THE PREFERRED EMBODIMENTS

Figure 1:
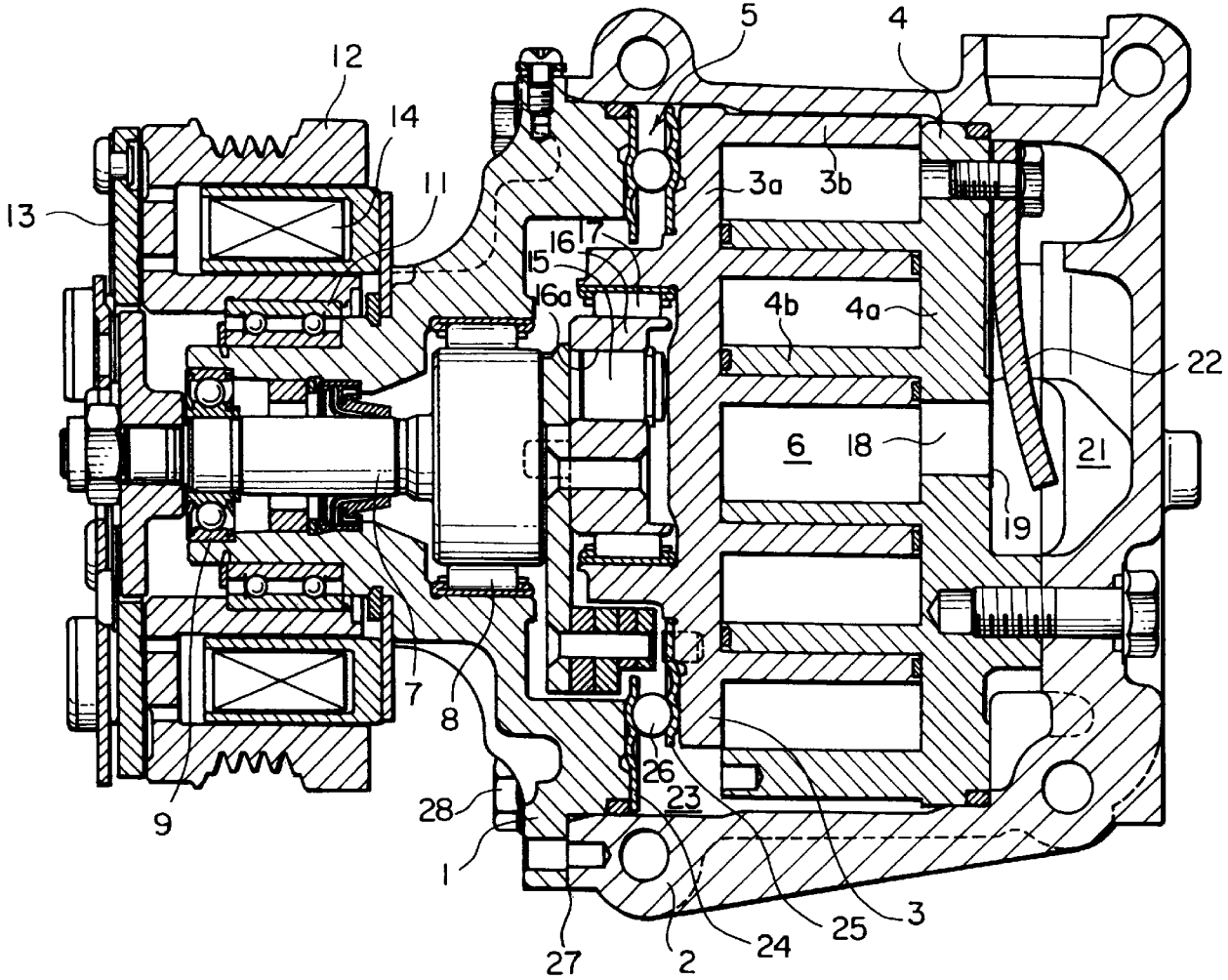
FIG. 1 RELATED ART
FIG. 1 is a sectional view of a scroll-type fluid machine of an earlier technology.
Figure 2:
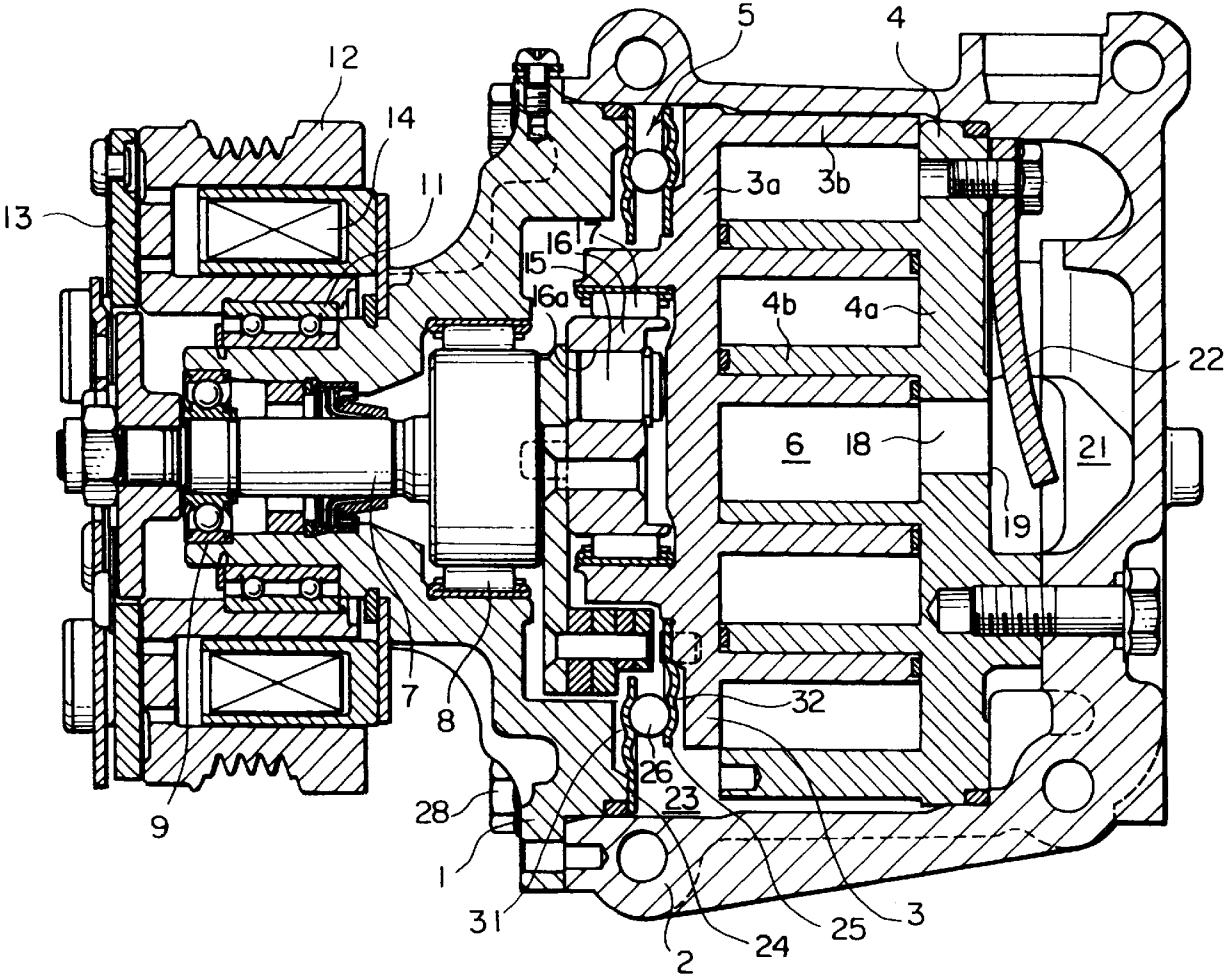
FIG. 2 is a sectional view of a scroll-type fluid machine according to a first embodiment of the present invention.

Referring to FIG. 2, description will be made as regards a scroll-type fluid machine according to a preferred and first embodiment of the present invention. In FIG. 2, only the same reference numerals are affixed to the same or like parts and elements of FIG. 1 and a further explanation will be omitted with respect to the elements for the purpose of simplification and clarification only.

In the scroll-type fluid machine, the movable and the fixed scroll members 3 and 4 are engaged with each other to thereby form a plurality of compression spaces 6 therebetween. The ball coupling 5 is disposed between the movable scroll member 3 and a stationary member or the front housing 1 that is in an opposed relation with the movable scroll member 3. The ball coupling 5 prevents a rotational movement of the movable scroll member 3 but permits the same (that is, the movable scroll member 3) to be moved in an orbiting motion. As a result of the orbiting motion, a fluid such as a refrigerant gas is compressed in the compression spaces 6. The ball coupling 5 will be referred to a rotation preventing arrangement.

Figure 3:
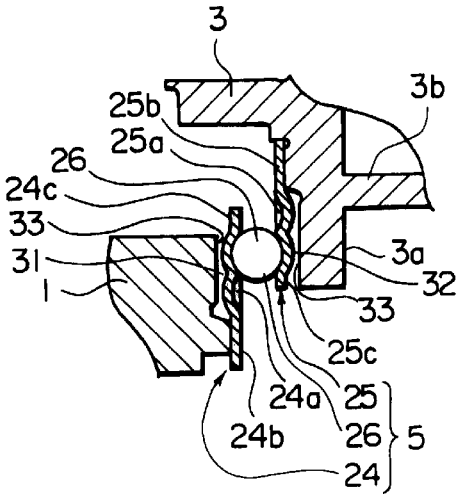
FIG. 3 is an enlarged sectional view of a principal portion of the scroll-type fluid machine shown in FIG. 2.

With reference also to FIG. 3 which shows a principal portion of the invention, there is provided a stationary side clearance 31 between a front housing 1 and a stationary side race 24 of the ball coupling 5, and a movable side clearance 32 between the movable scroll member 3 and a movable side race 25. The ball coupling 5 is supported between the front housing 1 and the movable scroll member 3. So that, the each of the stationary side race 24 and the movable side race 25 is permitted to be provided with elastic deflection. Each of the stationary side race 24 and the movable side race 25 are made of spring material to form a metal ring-like plate having a suitable resiliency. The metal ring-like plate has a plurality of annular grooves 24*a*, 25*a* being formed for receiving the balls 26 therein to permit rotary movement of the balls 26.

The stationary side race 24 has an outer circumferential portion 24*b* fixedly supported by the front housing 1, and an inner circumferential portion 24*c* which is spaced from the front housing 1 to form the stationary side clearance 31 and which serves to be a spring portion. The annular grooves 24*a* for the stationary side race 24 are formed on the inner circumferential portion 24*c*.

Figure 4:
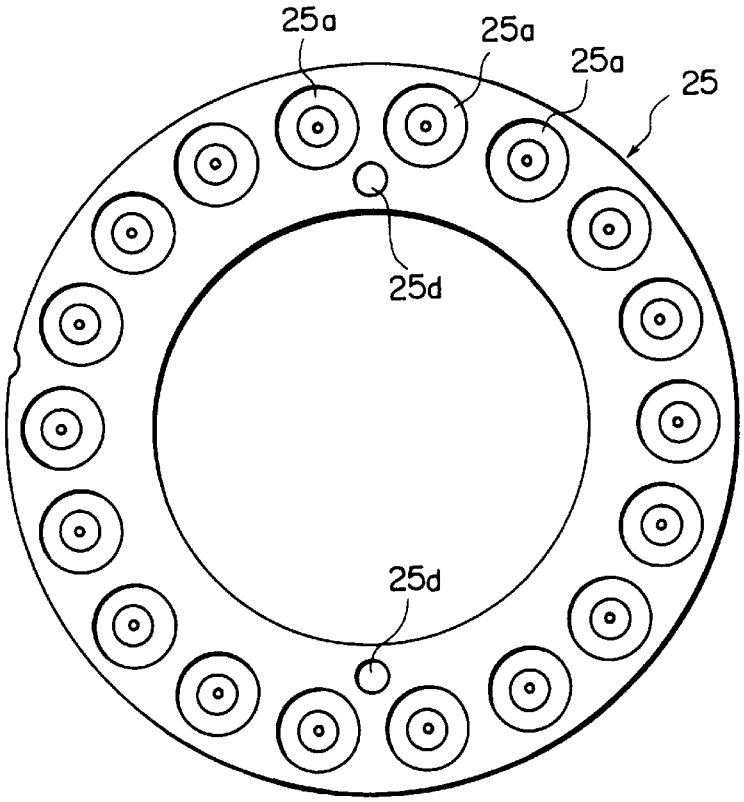
FIG. 4 is a front view of a movable side race used in the scroll-type fluid machine shown in FIG. 2.

On the other hand, the movable side race 25 has an inner circumferential portion 25*b* which is fixedly supported by the movable scroll member 3 to serve as a fixture portion, and an outer circumferential portion 25*c* which is spaced from the movable scroll member 3 to form the movable side clearance 32 and which serves as a spring portion. The annular grooves 25*a* are formed on the outer circumferential portion 25*c*. The movable race 25 is shown in FIG. 4 in which reference numeral 25 represents a fixture hole for being fixedly held by the movable scroll member 3.

The ball 26 is resiliently held between the inner circumferential portion 24*c* of the stationary side race 24 and the outer circumferential portion 25*c* of the movable race 25 and is slightly movable in an axial direction. In other words, the movable scroll member 3 is elastically urged towards the fixed scroll member 4 by the stationary side and the movable side races 24 and 25. In the state, a combination the stationary side and the movable side races 24 and 25 is referred to as an urging arrangement.

As a result, the movable scroll member 3 and the fixed scroll member 4 are contacted with each other in the axial direction, but the relative position of these scroll members 3 and 4 is variable within a very small range. Accordingly, a suitable clearance can be held between the movable scroll member 3 and the fixed scroll member 4 and, accordingly, it is not necessary now to control the clearance in the axial direction by using the spacers or shims which are needed in the earlier technology.

It is preferable that projections 33 are formed as deflection restriction portions on the front housing 1 and the movable scroll member 3. Each of the projections 33 will be referred to as a deflection restriction portion which limits or restricts the elastic deflection of each of the inner circumferential portions 24*c* of the stationary side race 24 and the outer circumferential portions 25*c* of the movable side race 25.

Figure 5:
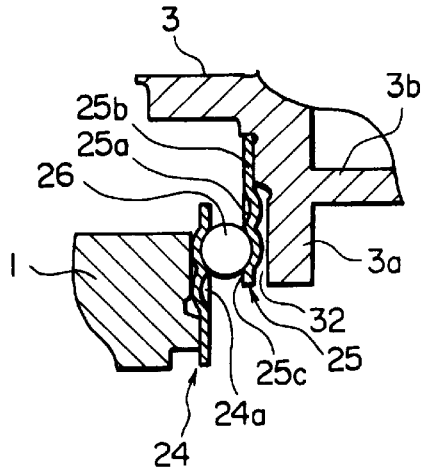
FIG. 5 is an enlarged sectional view of a principal portion of the scroll-type fluid machine according to a second embodiment of the present invention.

Turning to FIG. 5, the description will be made as regards a scroll-type fluid machine according to a second embodiment of the present invention. Similar parts are designated by like reference numerals.

In the scroll-type fluid machine, the movable side race 25 is spaced from the movable scroll member 3 to form the movable side clearance 32. On the other hand, the stationary side race 24 is in close contact with the housing 1. In this case, only the movable side race 25 serves as the urging arrangement.

Figure 6:
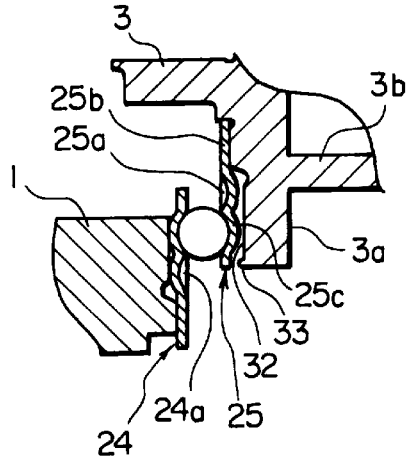
FIG. 6 is an enlarged sectional view of a modification of the structure of FIG. 5.

As shown in FIG. 6, the projection 33 may be formed on the movable scroll member 3. The projection 33 serves as the deflection restriction portion.

Figure 7:
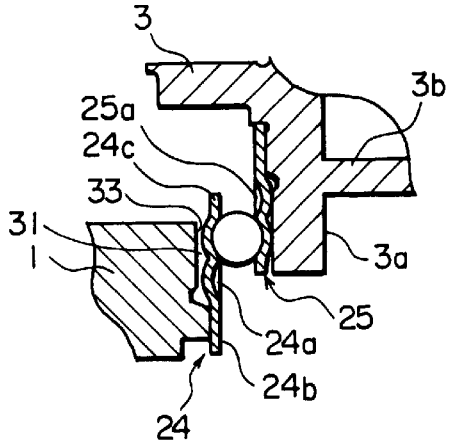
FIG. 7 is an enlarged sectional view of a third modification.

Turning to FIG. 7, the description will be made as regards a scroll-type fluid machine according to a third embodiment of the present invention. Similar parts are designated by like reference numerals.

In the scroll-type fluid machine, the stationary side race 24 is spaced from the housing 1 to form the stationary side clearance 31. On the other hand, the movable side race 25 is in close contact with the movable scroll member 3. In this case, only the stationary side race 24 serves the urging arrangement.

It would be preferable to provide the projection 33 described above so that the elastic deflection of the inner circumferential portion 24*c* of the stationary side race 24 is restricted.

Figure 8:
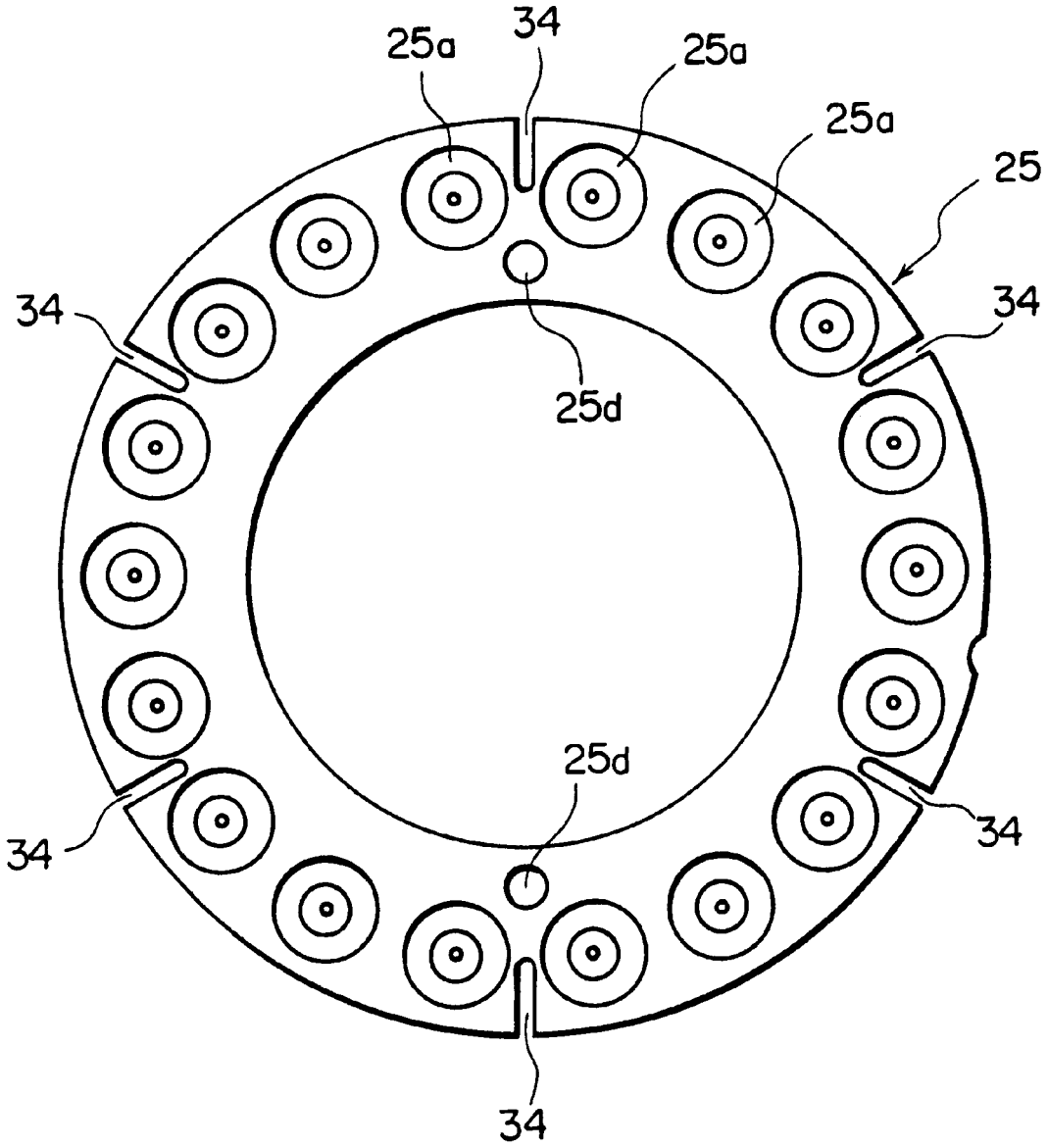
FIG. 8 is a front view of the movable race of the scroll-type fluid machine according to another embodiment of the invention.

Further, as shown in FIG. 8, a cut out portion 34 may be provided to the outer circumferential portion 25*c* of the movable side race 25 between the position of the annular grooves 25*a* so as to facilitate the deflection of the movable side race 25. The cut out portion 34 will serve as a spring adjustment means for adjusting a spring force of the movable side race 25. If necessary, a similar spring adjustment means can be provided to the inner circumferential portion 24*c* of the movable side race 24. The number and/or shape of the cut out portion can be selected as desired.

As described above, the present invention permits to control easily the axial clearance of both the fixed scroll member and the movable scroll member.

What is claimed is:

1. A scroll-type fluid machine comprising:

a stationary member;

a fixed scroll member fixed relative to said stationary member;

a movable scroll member placed between said stationary member and said fixed scroll member and engaged with said fixed scroll member to form a compression space between said fixed and said movable scroll members; and rotation preventing means interposed between said movable scroll member and said stationary member for preventing said movable scroll member from being rotated relative to said fixed scroll member, wherein said rotation preventing means comprises urging means placed between said stationary member and said movable scroll member for elastically urging said movable scroll member towards said fixed scroll member.

2. A scroll-type fluid machine as claimed in claim 1, further comprising:

means coupled to said movable scroll member for making said movable scroll member have an orbiting movement relative to said fixed scroll member.

3. A scroll-type fluid machine as claimed in claim 2, wherein said rotation preventing means comprises:

a stationary side race attached to said stationary member;

a movable side race attached to said movable scroll member to be opposite to said stationary side race; and a plurality of balls interposed between said stationary side race and said movable side race and cooperated with said stationary side race and said movable side race for preventing said movable side race from being rotated relative to said stationary side race.

4. A scroll-type fluid machine comprising:

a stationary member;

a fixed scroll member fixed relative to said stationary member;

a movable scroll member placed between said stationary member and said fixed scroll member and engaged with said fixed scroll member to form a compression space between said fixed and said movable scroll members;

urging means placed between said stationary member and said movable scroll member for elastically urging said movable scroll member towards said fixed scroll member;

means coupled to said movable scroll member for making said movable scroll member have an orbiting movement relative to said fixed scroll member; and rotation preventing means interposed between said movable scroll member and said stationary member and coupled to said urging means for preventing said movable scroll member from being rotated relative to said fixed scroll member, wherein said rotation preventing means comprises a stationary side race attached to said stationary member, a movable side race attached to said movable scroll member to be opposite to said stationary side race, and plurality of balls interposed between said stationary side race and said movable side race and cooperated with said stationary side race and said movable side race for preventing said movable side race from being rotated relative to said stationary side race, and wherein said stationary side race is made of spring material, a stationary side clearance being formed between said stationary member and said stationary side race to permit elastic deflection of said stationary side race, said stationary side race serving as said urging means.

5. A scroll-type fluid machine according to claim 4, wherein said stationary member has a deflection restriction portion for limiting said elastic deflection of the stationary side race.

6. A scroll-type fluid machine as claimed in claim 4, wherein said stationary side race is a ring-like plate and has spring adjustment means for adjusting a spring force thereof.

7. A scroll-type fluid machine according to claim 6, wherein said ring-like plate has a plurality of grooves for receiving said balls to permit rotary movement of said balls, respectively, said spring adjustment means being composed of a cut out portion formed on said ring-like plate between said grooves.

8. A scroll-type fluid machine comprising:

a stationary member;

a fixed scroll member fixed relative to said stationary member;

a movable scroll member placed between said stationary member and said fixed scroll member and engaged with said fixed scroll member to form a compression space between said fixed and said movable scroll members;

urging means placed between said stationary member and said movable scroll member for elastically urging said movable scroll member towards said fixed scroll member;

means coupled to said movable scroll member for making said movable scroll member have an orbiting movement relative to said fixed scroll member; and rotation preventing means interposed between said movable scroll member and said stationary member and coupled to said urging means for preventing said movable scroll member from being rotated relative to said fixed scroll member wherein said rotation preventing means comprises a stationary side race attached to said stationary member, a movable side race attached to said movable scroll member to be opposite to said stationary side race, and a plurality of balls interposed between said stationary side race and said movable side race and cooperated with said stationary side race and said movable side race for preventing said movable side race from being rotated relative to said stationary side race, and wherein said movable side race is made of spring material, a movable side clearance being formed between said movable scroll member and said movable side race to permit elastic deflection of said movable side race, said movable side race serving as said urging means.

9. A scroll-type fluid machine according to claim 8, wherein said movable scroll member has a deflection restriction portion for limiting said elastic deflection of the movable side race.

10. A scroll-type fluid machine as claimed in claim 8, wherein said movable side race is a ring-like plate and has spring adjustment means for adjusting a spring force thereof.

11. A scroll-type fluid machine according to claim 10, wherein said ring-like plate has a plurality of grooves for receiving said balls to permit rotary movement of said balls, respectively, said spring adjustment means being composed of a cut out formed on said ring-like plate between said grooves.

12. A scroll-type fluid machine comprising:

a stationary member;

a fixed scroll member fixed relative to said stationary member;

a movable scroll member placed between said stationary member and said fixed scroll member and engaged with said fixed scroll member to form a compression space between said fixed and said movable scroll members;

urging means placed between said stationary member and said movable scroll member for elastically urging said movable scroll member towards said fixed scroll member;

means coupled to said movable scroll member for making said movable scroll member have an orbiting movement relative to said fixed scroll member; and rotation preventing means interposed between said movable scroll member and said stationary member and coupled to said urging means for preventing said movable scroll member from being rotated relative to said fixed scroll member wherein said rotation preventing means comprises a stationary side race attached to said stationary member, a movable side race attached to said movable scroll member to be opposite to said stationary side race, and a plurality of balls interposed between said stationary side race and said movable side race and cooperated with said stationary side race and said movable side race for preventing said movable side race from being rotated relative to said stationary side race, and wherein each of said stationary and said movable side races is made of spring material, a stationary side clearance being formed between said stationary member and said stationary side race to permit elastic deflection of said stationary side race, a movable side clearance being formed between said movable scroll member and said movable side race to permit elastic deflection of said movable side race, a combination of said stationary and said movable side races serving as said urging means.

13. A scroll-type fluid machine according to claim 12, wherein each of said stationary and said movable scroll member has a deflection restriction portion for limiting said elastic deflection of each of said stationary and said movable side races.

14. A scroll-type fluid machine as claimed in claim 12, wherein each of said stationary and said movable side races is a ring-like plate and has spring adjustment means for adjusting a spring force thereof.

15. A scroll-type fluid machine according to claim 14, wherein said ring-like plate has a plurality of grooves for receiving said balls to permit rotary movement of said balls, respectively, said spring adjustment means being composed of a cut out formed on said ring-like plate between said grooves.

16. A scroll-type fluid machine as claimed in claim 1, further comprising a housing containing therein said fixed scroll member and the movable scroll member, said stationary member being composed of a part of said housing.

17. The scroll type fluid machine of claim 4 wherein said stationary side race and said movable side race each has a plurality of annular grooves therein for receiving said plurality of balls therebetween, and wherein said plurality of balls are interposed between said annular grooves of said stationary side race and said annular grooves of said movable side race, thereby permitting rotary movement of said plurality of balls within said annular grooves.

* * * * *